US005289749A

United States Patent [19]

Imai et al.

[11] Patent Number: 5,289,749

[45] Date of Patent: Mar. 1, 1994

[54] APPARATUS FOR DETECTING ABNORMAL CONDITION OF CUTTABLE OBJECTIVE MATERIAL FOR USE IN A CUTTING MACHINE

[75] Inventors: Taichi Imai; Toshiro Ochi, both of Wakayama, Japan

[73] Assignee: Shima Seiki Mfg., Ltd., Wakayama, Japan

[21] Appl. No.: 935,180

[22] Filed: Aug. 26, 1992

[30] Foreign Application Priority Data

Aug. 26, 1991 [JP] Japan ..... 3-213833
Jun. 30, 1992 [JP] Japan ..... 4-172324

[51] Int. Cl.[5] ..... B26D 5/00

[52] U.S. Cl. ..... 83/67; 83/371; 83/451; 83/941

[58] Field of Search ..... 83/64, 371, 76.8, 936, 83/937, 938, 939, 940, 941, 63, 65, 66, 67, 451

[56] References Cited

U.S. PATENT DOCUMENTS 2,679,307 5/1954 Koch ..... 83/64 X
3,029,775 4/1962 Nicholson ..... 83/64 X
3,747,454 7/1973 Gerber ..... 83/941 X

*Primary Examiner*—Richard K. Seidel
*Assistant Examiner*—Kenneth E. Peterson
*Attorney, Agent, or Firm*—Edwin E. Greigg; Ronald E. Greigg

[57] ABSTRACT

An apparatus for detecting abnormal conditions of a fabric on a table and a cutter which is movable along a length of the table for cutting at any desired angle relative to a center line. The abnormal condition is detected before the material is cut thereby avoiding cutting a material with an abnormality.

2 Claims, 8 Drawing Sheets

APPARATUS FOR DETECTING ABNORMAL CONDITION OF CUTTABLE OBJECTIVE MATERIAL FOR USE IN A CUTTING MACHINE

BACKGROUND OF THE INVENTION

1. Field of the Invention

The present invention relates to an apparatus for detecting an abnormal condition of a cuttable objective material, like a raised domain of laminated fabric secured on a plane mounting table before cutting them into desired shapes with a cutter blade.

2. Description of the Prior Art

As is typically disclosed in the Japanese Patent Publication No. 55-45357 of 1980 for example, there is such a proposal apparatus for detecting a crease or an abnormal condition of a cuttable objective material following detection of elastic deformation of a cutter blade in the light of such a phenomenon in which the cutter blade is subject to elastic deformation by a variable load applied onto the cutter blade, where the amount of load is variable when the cutter blade cuts such a domain bearing a crease and such a domain free of a crease.

Nevertheless, when operating the conventional abnormal-condition detecting apparatus offered by the above-cited art, the apparatus merely detects a fact that the cutter blade has just cut an abnormal domain of a cuttable material bearing a defective symptom in succession to the detection of elastic deformation occurred in the cutter blade. Therefore, the apparatus offered by the above-cited art could not precisely normalize the abnormal part of the cuttable material in advance of the cutting operation with the cutting blade.

In consequence, once the apparatus detects an abnormal domain on the cuttable fabrics, these fabric pieces can no longer be available for industrial and commercial uses, thus resulting in the decreased yield rate and productivity. This in turn raises the cost in the material-cutting process and the actual cost of cut-off fabrics as well.

SUMMARY OF THE INVENTION

To fully solve those problems cited above, the invention hereby provides a novel apparatus for previously detecting an abnormal condition of a cuttable material (like laminated fabrics for example) for use in combination with a cutting machine comprising a material-mounting table for mounting the cuttable material and a cutter blade which is disposed on the material-supporting plane surface and capable of freely moving itself in desired directions; wherein the cutting machine transfers the cuttable material on the supporting plane surface from one direction to the other direction in the longitudinal direction of the material-supporting surface on the way of cutting the objective material into a predetermined shape by operating a cutter blade.

Concretely, the apparatus for detecting an abnormal condition of a cuttable objective material comprises the following; a cutter-blade supporting member which supports a cutter blade having a bottom surface coming into contact with the top surface of the cuttable material by way of slidably moving itself in the vertical direction and a detecting member which at least detects the rise of the cuttable material on the downstream side in the direction of the cutting operation performed by the cutter blade; wherein the detecting member comprises a movable member which displaces itself in the vertical direction and a detecting member which detects a displaced amount of the movable member. In addition, another movable member available for the detecting member is also provided, which comprises a blade supporting member supporting the cutter blade so that the cutter blade can slidably ascend and descend itself.

Furthermore, an annular movable member is also provided for the detecting member by way of being disposed in the neighborhood of an external periphery of the blade supporting member.

Furthermore, a detecting member is also provided for the detecting system. This detecting member comprises a rotary encoder available for detecting a displaced amount of the movable member.

Furthermore, a contact-type detecting member is also available for the detecting system. This detecting member enters a conductive condition when being brought into contact with a contact member while the movable member displaces itself.

DETAILED DESCRIPTION OF THE PREFERRED EMBODIMENTS

The First Embodiment

Figure 1:
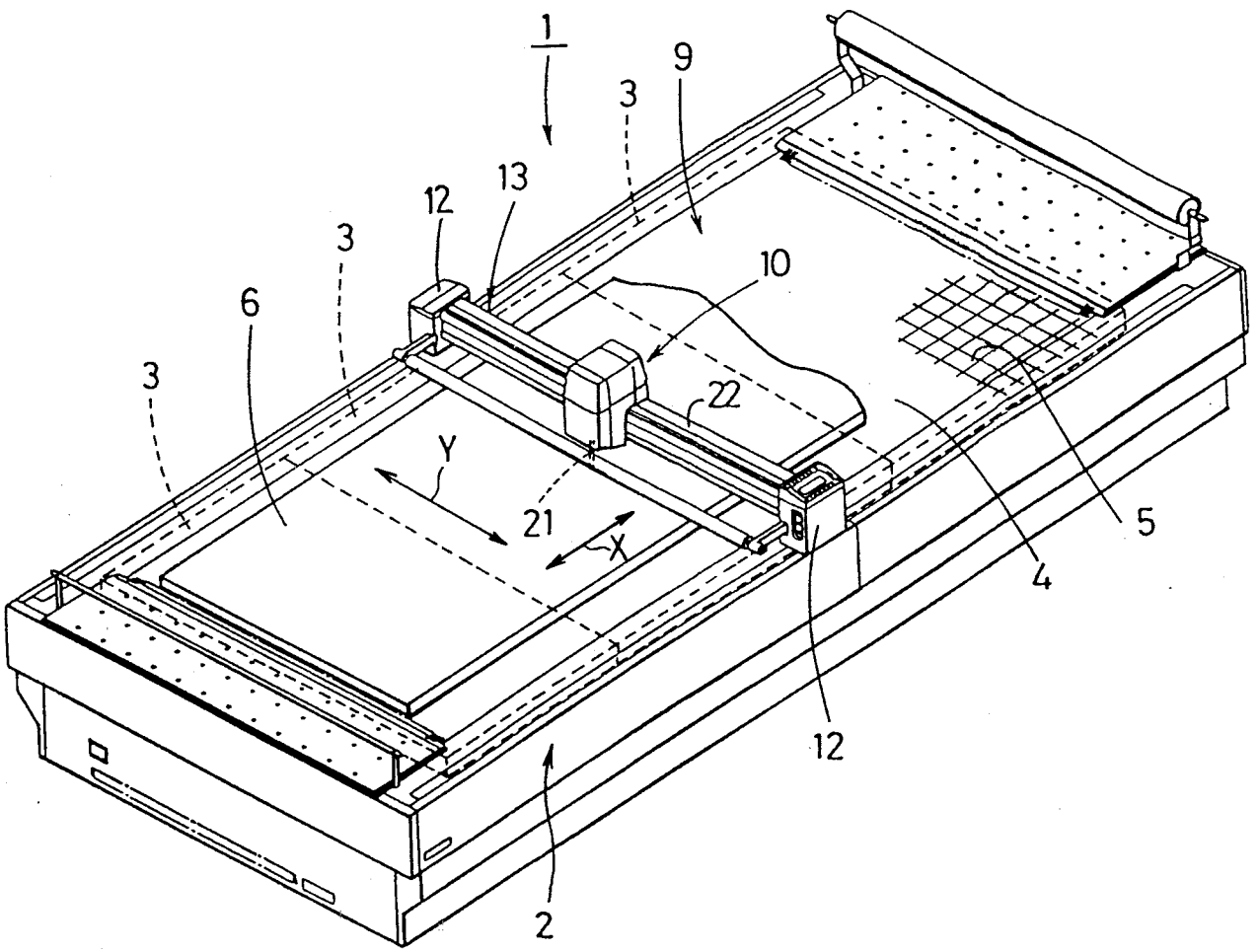
FIG. 1 is an overall perspective view of the cutting machine incorporating the apparatus according to the first embodiment of the invention.
Figure 2:
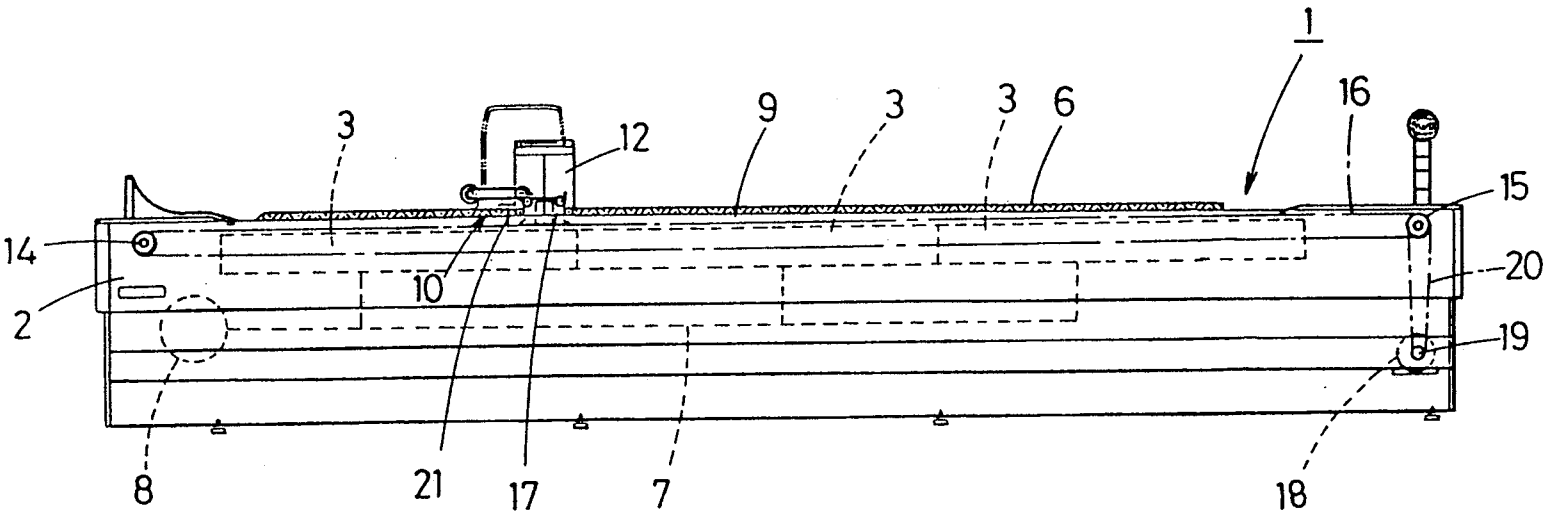
FIG. 2 is a lateral view of the cutting machine incorporating the apparatus according to the first embodiment of the invention.

FIG. 1 is the overall perspective view of the cutting machine incorporating a sealing device of a cuttable material absorptive/mounting table. FIG. 2 is the lateral view of the cutting machine shown in FIG. 1. The reference numeral 1 designates the cutting machine.

Structurally, the cutting machine 1 comprises the following; three suction boxes 3, 3, 3, which are horizontally disposed on a base frame 2; a rigid-hair assembly 5 which is disposed in order that it can endlessly travel on these three suction boxes 3 and form a cuttable-material supporting surface 4 on those three suction boxes 3; an absorptive mounting table 9 comprising a suction duct 7 which generates a absorptive force on the material supporting surface 4 including the rigid hair assembly via those three suction boxes 3 in order to securely hold a cuttable objective material 6 like laminated fabrics or laminated knits for example and a suction device 8; and a cutting unit which is disposed on the cuttable-material supporting surface 4 so that it can freely travel itself in any desired direction.

A pair of endless chains are disposed on both sides of a widthwise direction of each suction box 3 in the longitudinal direction of the base frame 2. A pair of conventional endless track conveyor units having a number of receiver plates held by those endless chains on both sides of the external circumference of these both-side endless chains like the one disclosed in the Japanese Patent Publication No. 63-28759 and others. The rigid-hair assembly 5 is laid on the top surface of each receiver plate to properly form the material-supporting surface 4

The above-identified cutting unit 10 comprises a pair of members 12 which respectively move in the X-axial direction and a drive member 13 which moves itself in the Y-axial direction. Those two members 12 which moves themselves in the X-axial direction respectively wind a belt 16 attached with a movable blade across a pair of gears 14 and 15 rotatably being provided between both ends in the longitudinal direction of the absorptive mounting table 9. A bottom edge of a block 17 is connected to part of the belt 16 attached with a movable blade. The gear 15 is disposed at an end of the absorptive mounting table 9 in order to wind the belt 16 attached with a movable blade on it. Structurally, the gear 16 is interlinked with an output shaft 19 of a drive motor 18 via a drive belt 20 attached with a blade. In consequence, structurally, by properly controlling the direction and the speed of the rotation of the drive motor 18 via the movable belt 16 and the drivebelt 20 respectively being attached with a blade, a cutter blade 21 is permitted to move in the X-axial direction, in other words, in the longitudinal direction of the absorptive mounting table 19.

Figure 3:
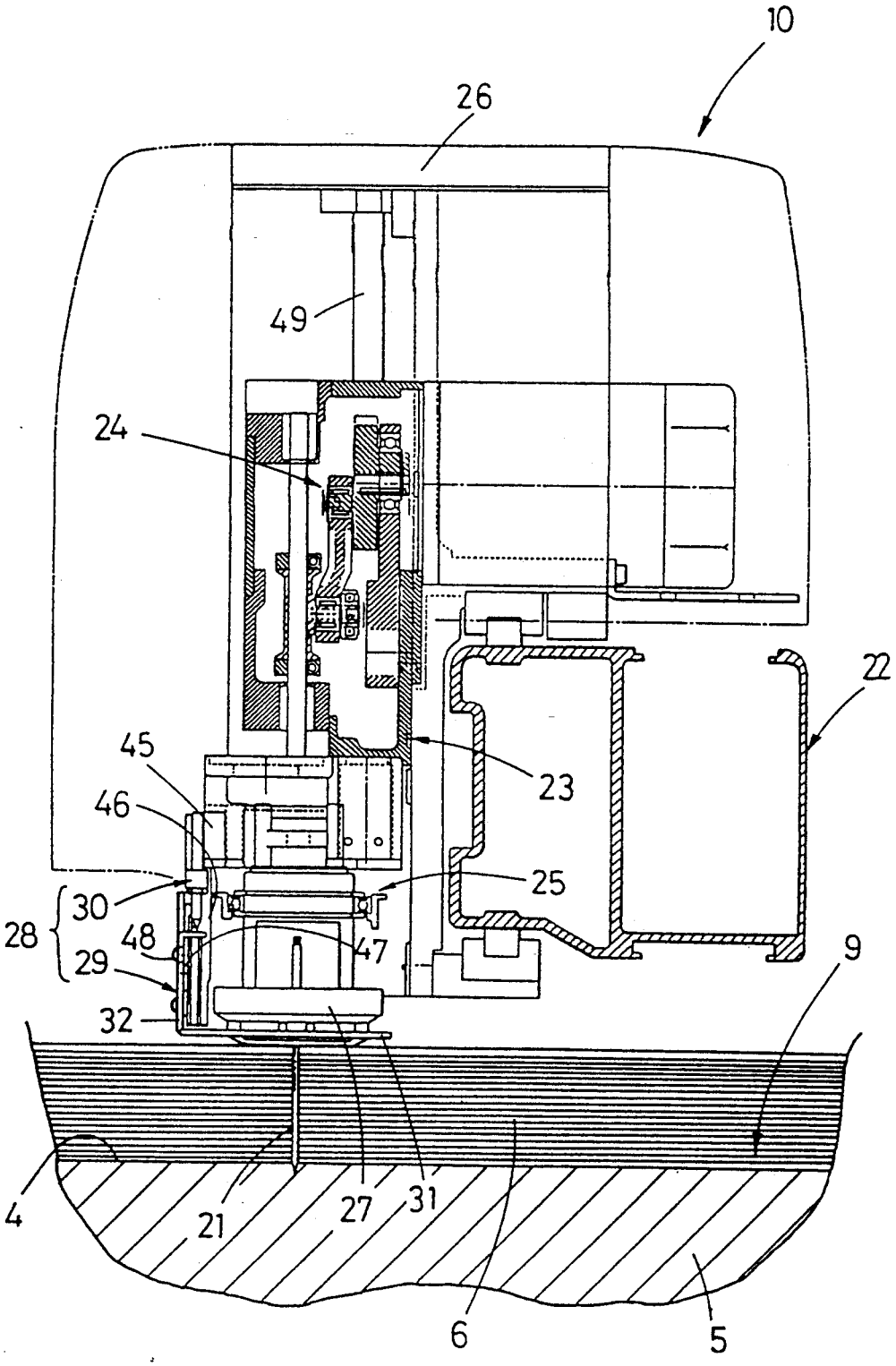
FIG. 3 is a lateral view of components of the cutting machine incorporating the apparatus according to the first embodiment of the invention.

The above-identified Y-axial direction drive member 13 has the structure shown in FIG. 3, in which a guide bridge 22 is secured between those X-axial direction movable members 12 respectively being provided in the widthwise direction of the absorptive mounting table 9, whereas a frame 23 supporting the cutter blade 21 is driven in the Y-axial direction by a Y-axial direction drive motor (not shown) via the guide bridge 22.

Figure 4:
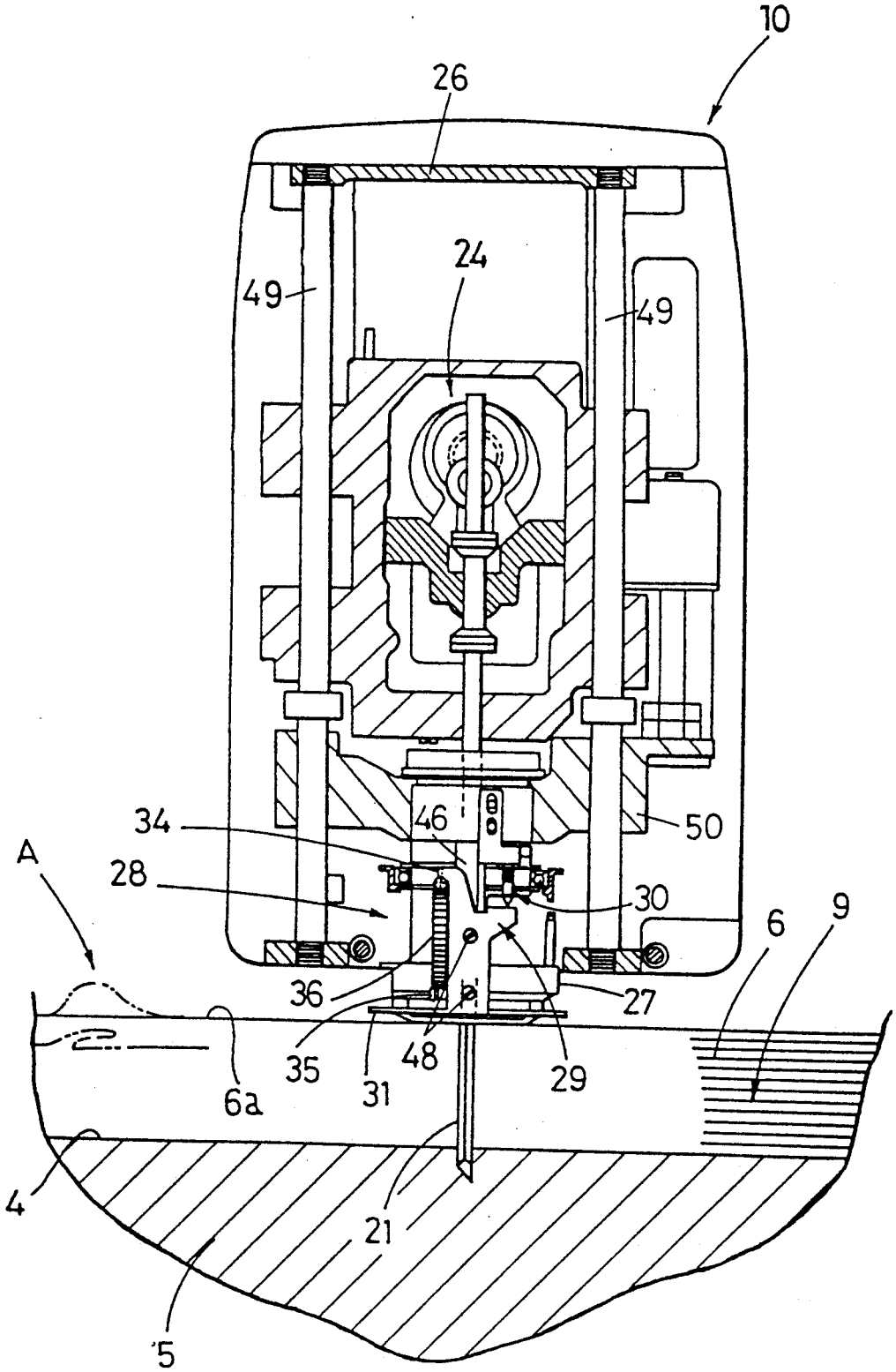
FIG. 4 is a front view of components of the cutting machine incorporating the apparatus according to the first embodiment of the invention.

As shown in FIGS. 3 and 4, the cutter blade 21 is provided with a blade-tip direction controller 25 which is vertically oscillated by an oscillating means 24 secured to the upper end of the frame 23 and exerts control in order that, the tip of the cutter blade 21 is constantly oriented in the cutting direction below this oscillating means 24. A blade supporting member 27 is installed below the blade-tip direction controller 25, where the blade-supporting member 27 holds the cutter blade 21 by permitting the cutter blade 21 to slidably ascend and descend itself, and yet, the bottom surface of the blade-supporting member 27 comes into contact with the top surface of the cuttable material 6 when the cutter blade 21 cuts off the objective material 6.

A pair of guide rods 49 and 49 provided for the above-identified oscillating means 24 are vertically installed inside of a casing 26 of the cutter unit 10. A slidable block 50 is disposed below the oscillating means 24 so that it can slidably ascend and descend. The slidable block 50 supports the upper end of the blade-supporting member 27 to permit a pneumatic cylinder (not shown) to lift and lower the sliding block 50 and the blade-supporting member 27 in association with the oscillating means 24.

An abnormal-condition detecting unit 28 is secured on the external surface of the blade-supporting member 27 in order to detect the rise of the cuttable material 6 on the downstream side in the direction of proceeding the cutting operation. The abnormal-condition detection unit 28 comprises a movable member 27 which is capable of displacing itself in the vertical direction and a detecting member 30 which detects the displaced amount of the movable member 29.

Figure 5:
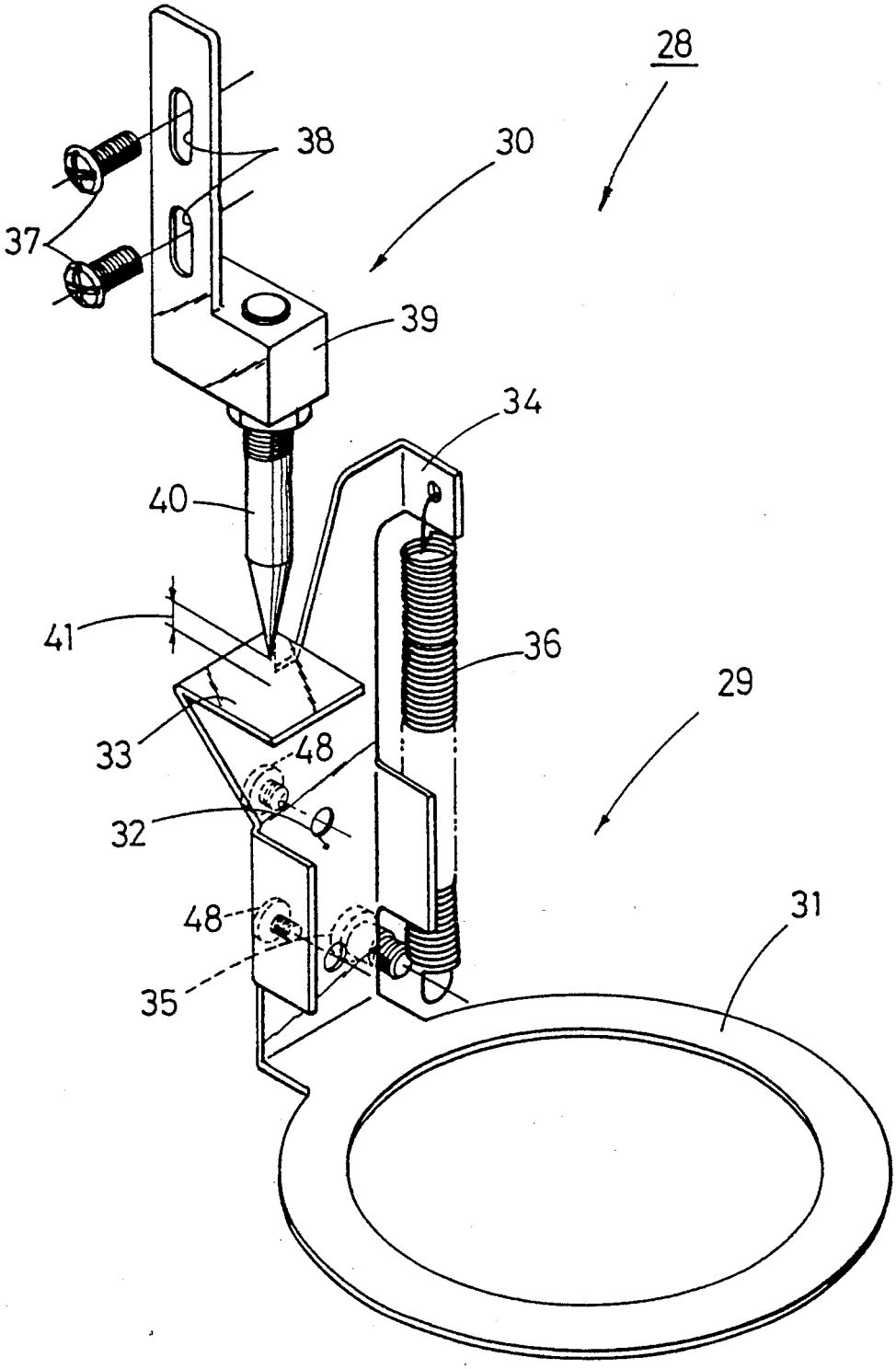
FIG. 5 is a perspective view of disassembled components of the cutting machine according to the first embodiment of the invention.

As shown in FIGS. 3 through 5, the movable member 29 comprises an annular-shape plane and dough-nut-like member 31 having an end being folded upward, a slide-movement guide member 32, a contact member 33 having a substantially horizontal surface, and a spring holder 34. The slide-movement guide member 32 is secured to a linear bearing 47 via a screw 48, where the linear bearing 47 slidably lifts and lowers a bracket 46 which is vertically extended from a supporting frame 45. The movable member 29 is downwardly energized by tensile force of a weak-tensional spring 36 engaged between the spring holder 34 and a spring-receiving screw 35 which is screwed in a fixing member provided on the part of the blade-supporting member 27.

As shown in FIG. 5, the abnormal-condition detecting member 30 comprises the following; a bracket 39 which is secured to the fixing member on the part of the blade-supporting member 27 above the movable member 29 so that the position of the bracket 30 can properly be adjusted in the vertical direction by means of a screw 37 and a lengthy through-hole 38; and a needle-like rod 40 which is secured to the bracket 30 with a screw. Fine adjustment of interval 41 between the needle-like rod 40 and the contact member 33 of the movable member 29 is executed by means of a spiral coupling between the bracket 39 and the needle-like rod 40.

Before actually operating the apparatus for detecting an abnormal condition of a cuttable material 6 provided for the cutting machine having the structure described above, initially, a fabric spreader is operated to supply a predetermined number of lamited fabrics 6 on the material-supporting surface 4 formed by means of a rigid-hair assembly 5.

Initially, those three suction boxes 3 are held inoperative. Next, as soon as operation of the chains (not shown) is activated, the receiver plate integrally securing the rigid-hair assembly 5 thereon rotates in the counterclockwise direction on those three suction boxes 3 to permit a unit of laminated fabrics 6 to be delivered onto the effective cutting domain on the material-supporting surface 4.

Next, an absorptive force generated by these suction boxes 3 absorbs the cuttable laminated fabrics 6 on the effective cutting domain to securely fix them on the material-supporting surface 4. Next, the bottom surface of the blade supporting member 27 comes into contact with the top surface of the cuttable laminated fabrics 6. When this condition is present, operating staff sets an interval 41 between the contact plate 33 and the needle-like rod 40 of the detecting member 30 at the moment to permit the movable member 29 to become conductive when the movable member 29 comes into contact with the detecting member 30. In this case, the operating staff needs to consider the sinkable amount of the cuttable fabrics 6 caused by pressure generated by the blade-supporting member 27.

Next, the operator activates operation of the cutter unit 10 to sequentially cut the objective laminated fabrics 6 into a predetermined shape. While the cutting operation is underway, by effect of the drive force from the drive motor 18, the cutter unit 10 is moved in the X-axial direction (from the left to the right in FIG. 1) at a predetermined operating speed via the drive belt 20 attached with a blade and the movable belt 16 attached with a blade.

Next, as shown in FIG. 4 with an imaginary chained line, if a raised domain A were present on the surface 6*a* of the cuttable fabric 6 as a result of generation of a crease or double fold effect in the fabric 6 on the downstream side in the direction of proceeding the cutting operation with the cutter blade 21, then, the movable member 29 of the abnormal-condition detecting unit 28 is lifted in resistance against a tensile force of the spring 36. In consequence, the top surface of the contact plate 33 and the bottom tip of the needle-like rod 40 of the detecting member 30 are brought into contact with each other so that they can integrally become conductive. In the event that any abnormal condition is present on the cuttable laminated fabrics 6, this faulty condition is securely detected before the faulty domain is cut off.

Practically, as soon as the faulty domain is detected on the cuttable fabric 6, the cutting machine 1 can generate an alarm or stop the operation of the cutting machine itself to securely implement a corrective measure before cutting off the laminated fabrics 6 bearing the defective domain.

Even when such a raised faulty domain A were present on the cuttable laminated fabric 6 because of poor cutting effect caused by the worn or broken blade 21 on the way of executing a cutting operation to result in the generation of crease or double folding effect without being able to precisely cut off the laminated fabrics 6 for example, in the same way as was done for the preceding case, the movable member 29 of the abnormal-condition detecting unit 28 is lifted in resistance against a tensile force of the spring 36. In consequence, the top surface of the contact plate 33 of the lifted movable member comes into contact with the bottom tip of the needle-like rod 40 of the detecting member 30 to have them enter into conductive condition. This securely enables the apparatus embodied by the invention to previously detect any presence of an abnormal condition on the cuttable fabric 6.

The first embodiment provides the abnormal-condition detecting unit 28 with an annular-shaped movable member 31. Nevertheless, the scope of the invention does not merely confine the shape of the movable member to be of annular shape, but the invention also permits introduction of any practical shape capable of detecting an abnormal condition of a cuttable fabric on the downstream side in the direction of proceeding of a cutting operation with the cutter blade 21, in other words, by way of following up the direction of the movement of the cutter blade 21.

The Second Embodiment

Figure 6:
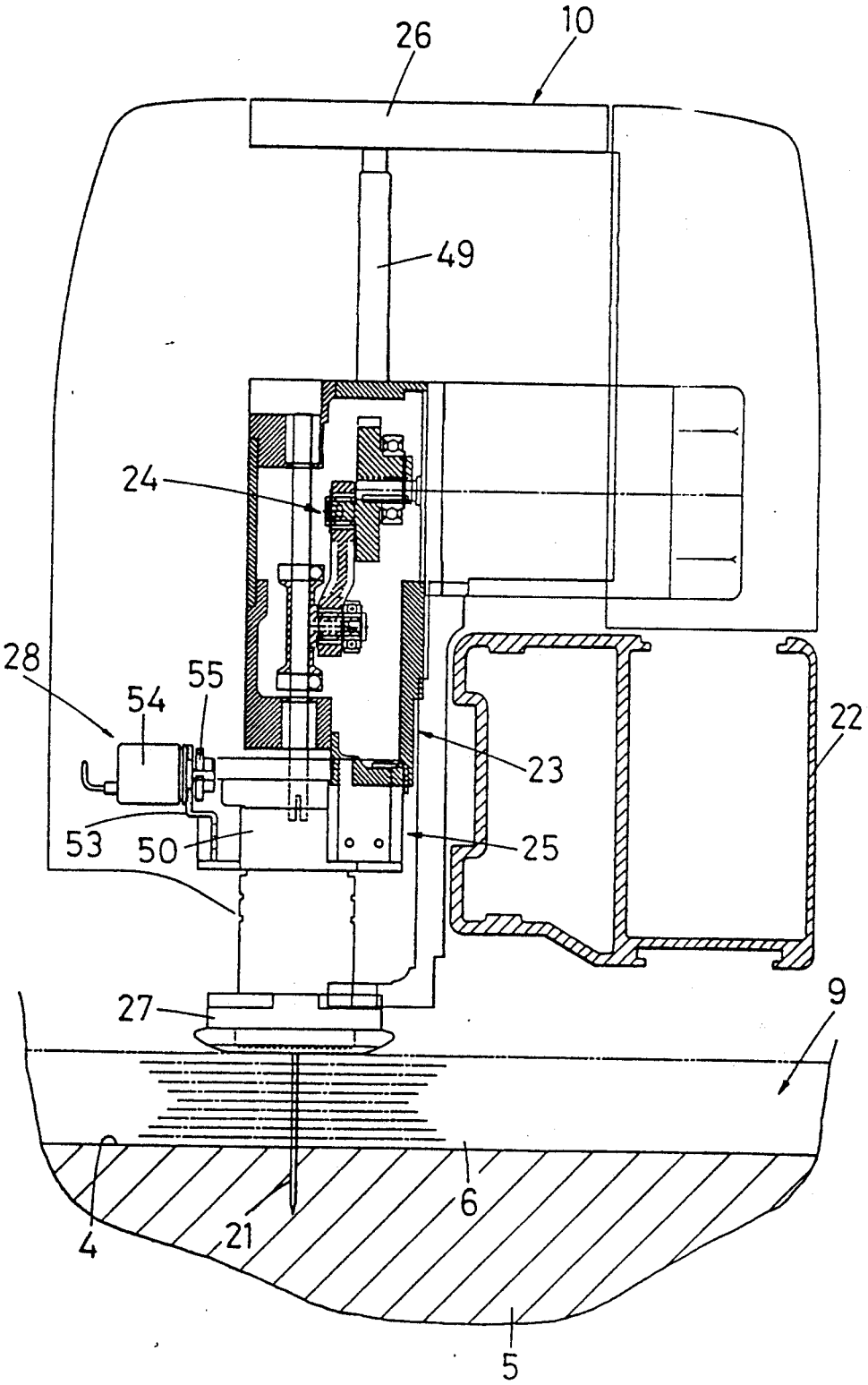
FIG. 6 is a lateral view of the cutting machine incorporating the apparatus according to the second embodiment of the invention.
Figure 7:
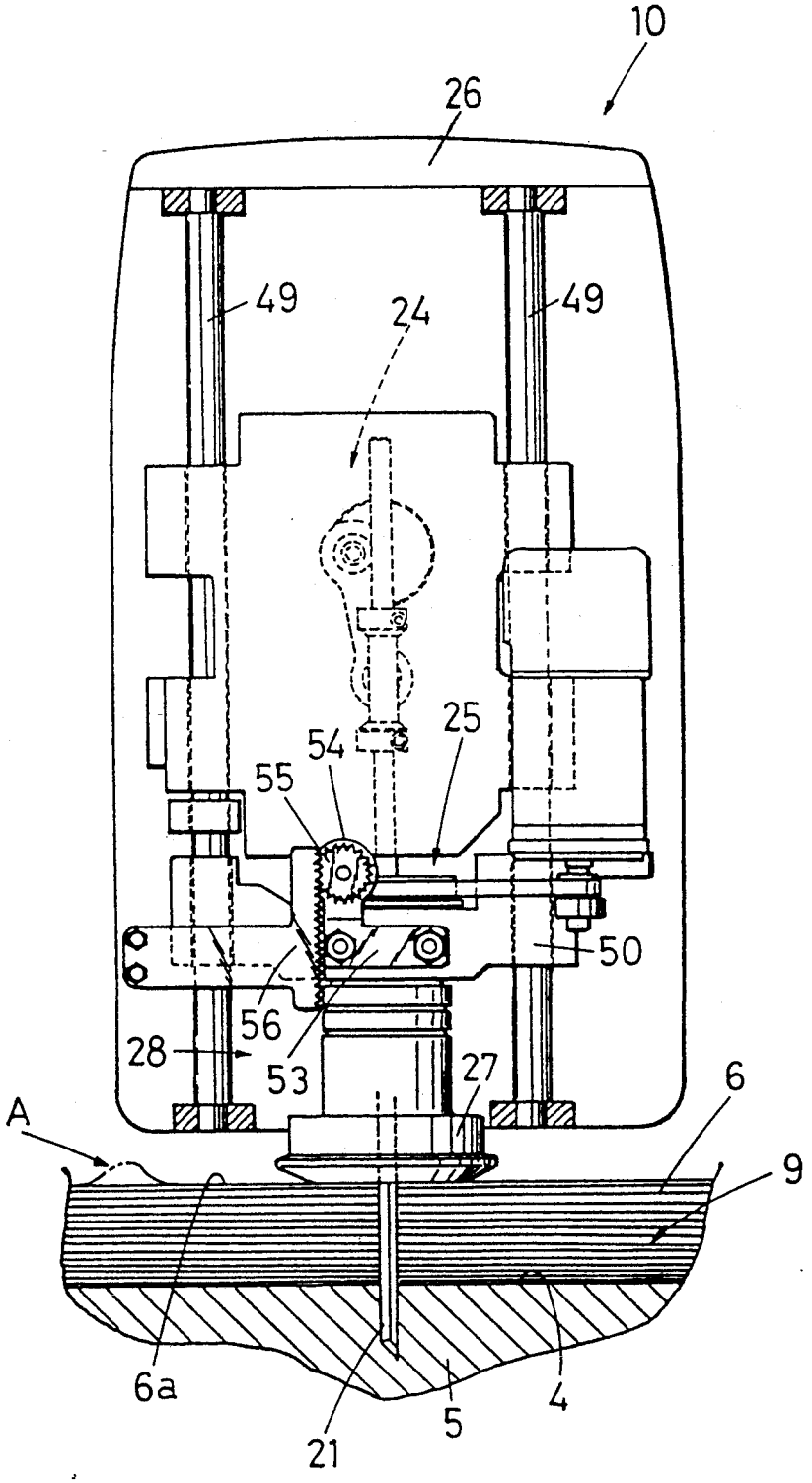
FIG. 7 is a front view of the cutting machine incorporating the apparatus according to the second embodiment of the invention.
Figure 8:
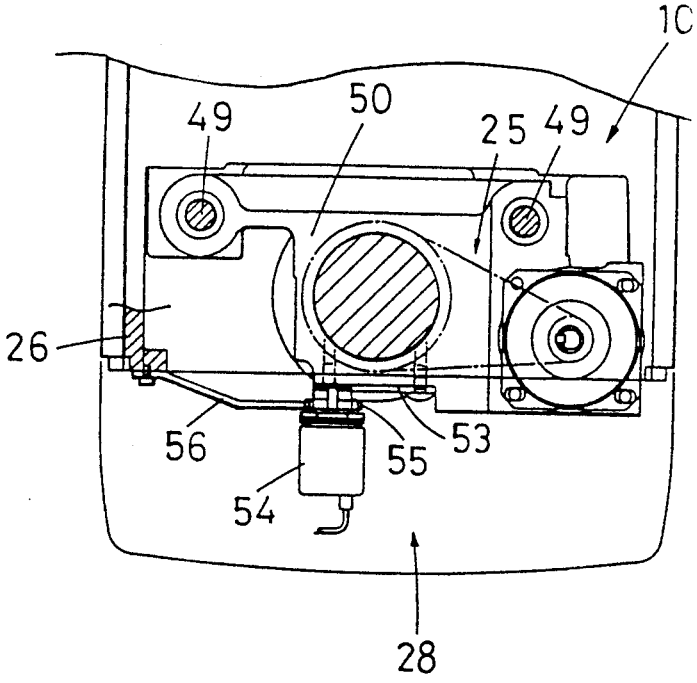
FIG. 8 is a sectional plan of the cutting machine incorporating the apparatus according to the second embodiment of the invention.

The apparatus for detecting an abnormal condition of a cuttable objective material for use in combination with a cutting machine according to the second embodiment of the invention substantially corresponds to the one which is partially modified from the structure of the abnormal-condition detecting unit 28 of the first embodiment as shown in FIGS. 6 through 8.

Concretely, the abnormal-condition detecting unit 28 according to the second embodiment of the invention features the structure described below.

A movable member capable of displacing itself in the vertical direction is formed by means of a blade supporting member 27. In order to detect the displaced amount of the blade-supporting member 27, an "L"-shaped bracket 53 (shown in the lateral view) is extended from a slidable block 50 which supports the blade-supporting member 27. A rotary encoder 54 is secured to the tip of the "L"-shaped bracket 53. A rack 56 engaged with a pinion gear 55 of the rotary shaft of the rotary encoder 54 is secured to a casing 26.

Next, functional operation of the abnormal-condition detecting unit 28 featuring the above structure is described below. Like the first embodiment, initially, a fabric spreader delivers a predetermined number of laminated fabrics 6 onto the material-supporting surface 4. Next, a absorptive force is generated by three suction boxes 3, 3, 3, to secure the laminated fabrics 6 onto the material-supporting surface 4.

Next, the blade-supporting member 27 is lowered until the bottom surface of the blade-supporting member 27 is brought into contact with the top surface of the laminated fabric 6, and then, the cutter unit 10 is activated to sequentially cut the laminated fabrics 6 into a predetermined shape.

While the cutting operation is underway, if there were such a raised domain A on the surface 6*a* of the laminated fabric 6 shown in FIG. 7 with an imaginary chained line as a result of the generation of a crease or double-fold effect on the laminated fabrics 6 on the downstream side in the direction of proceeding of the cutting operation with the cutting blade 21 for example, then, the blade-supporting means 27 of the abnormal-condition detecting unit 28 is lifted by the raised domain A.

Then, in response to the ascending movement of the blade supporting member 27, a relative transfer is generated between the pinion gear 55 on the rotary shaft of the rotary encoder 54 and the rack 56 engaged with the pinion gear 55 to cause the pinion gear 55 to rotate, thus enabling the rotary encoder 54 to output a signal designating the amount of the relative transfer to a control unit which is not shown.

The control unit identifies that an abnormal condition is present when the received signal designating the amount of the relative transfer exceeds a predetermined value (the signal value indicating the amount of the relative transfer output simultaneous with the detection of an extremely fine projection and recess on the surface of the cuttable laminated fabrics 6). In this way, the abnormal-condition detecting unit 28 securely detects the presence of an abnormal condition from the cuttable laminated fabrics 6 before permitting the cutter blade 21 to cut off the defective domain.

Concretely, in response to the detected abnormal condition on the cuttable laminated fabrics 6, the cutter machine itself can generate an alarm or stop its own operation, thus properly normalizing the abnormal condition before permitting the cutter blade 21 to cut off the defective domain.

Even when such a raised domain A were present on the cuttable laminated fabric 6 because of a poor cutting effect generated by the worn or broken blade on the way of executing a cutting process to merely result in the generation of an unwanted crease of a double-fold effect without being able to precisely cut off the laminated fabrics 6, in the same way as was done for the first embodiment, as soon as the movable member 29 of the abnormal-condition detecting unit 28 is lifted, the pinion gear 55 on the rotary shaft of the rotary encoder 54 is rotated to permit the rotary encoder 54 to simultaneously output a signal designating the amount of a relative transfer to the control unit which is not shown.

In this way, like the first embodiment, the control unit identifies that an abnormal condition is present when the received signal designating the amount of relative transfer exceeds a predetermined value (the signal value indicating the amount of the relative transfer output simultaneous with the detection of extremely fine projection and a recess on the surface of the cuttable laminated fabric 6). In this way, the abnormal-condition detecting unit 28 securely detects the presence of an abnormal condition from the cuttable laminated fabrics 6 before permitting the cutter blade 21 to cut off the defective domain.

The preceding first embodiment of the invention permits the abnormal-condition detecting unit 28 to detect the rise of the movable member 29 of the abnormal-condition detecting unit 28 by way of detecting the presence of a raised domain A of the cuttable laminated fabric 6 by operating the contact-type detecting member 30. Alternatively, the second embodiment of the invention may replace the contact-type detecting member 30 with a limit switch, and yet, may compose the abnormal condition detecting unit 28 by means of a distance sensor availing of an ultrasonic wave.

The second embodiment has formed the movable member 29 of the abnormal-condition detecting unit 28 by means of the blade-supporting member 27 mounting the rotary encoder 54. According to the second embodiment, the rack 56 engaged with, the pinion gear 55 of the rotary shaft of the rotary encoder 54 is secured to the casing 26 to permit the detecting unit 28 to detect abnormal condition of the cuttable laminated fabrics 6 by referring to the amount of relative transfer between the pinion gear 55 and the rack 56. In place of this mechanism, it is also practicable for the second embodiment to securely detect abnormal condition on the cuttable laminated fabrics 6 by applying variable pressure of fluid in a pneumatic cylinder (not shown) which operates the slidable block 50 when the blade-supporting member 27 ascends itself. Furthermore, the first and second embodiments of the invention have respectively introduced the movable absorptive-mounting table 9. However, the invention can also be implemented by applying a stationary absorptive-mounting table 9 as well.

What is claimed is:

1. An apparatus for detecting an abnormal condition of a cuttable material (6) previous to cutting with a cutting machine (1) which comprises a material-mounting table (9) capable of stationarily holding the cuttable material (6) on a top surface and a cutter blade (21) which is freely movable in any desired direction and disposed above said material-mounting table(9), said cutting machine (1) movable from one direction to another direction in a longitudinal direction of the material-mounting table (9), said cutting machine (1) further comprising; a blade-supporting member (27) which vertically and slidably supports said cutter blade (21), said blade-supporting member (27) is supported by a slidable block (50) which is supported by a casing (26), said blade supporting member (27) is pivotably controlled by a blade-tip direction controller (25) to control a cutting direction of the cutter blade (21), said blade-supporting member (27) includes a bottom surface which comes into contact with a top surface of the cuttable material (6), and an abnormal-condition detector (28) which comprises an annular member (31) in a horizontal plane which is vertically and slidably disposed to the casing (26), said annular member (31) is energized downwardly by tensile force of a spring (36) in the neighborhood of an external periphery of said blade-supporting member (27), said annular member (31) or said casing (26) comprises a contact member (33) which completes an electrical circuit when the annular member (31) is lifted in resistance against a tensile force of the spring (36), whereby a rise of said cuttable material (6) in a direction of a movement of said cutter blade (21) is detected.

2. An apparatus for detecting an abnormal condition of a cuttable material (6) previous to cutting with a cutting machine (1) which comprises a material-mounting table (9) capable of stationarily holding the cuttable material (6) on a top surface and a cutter blade (21) which is freely movable in any desired direction and disposed above said material mounting table (9), said cutting machine (1) is movable from one direction to another direction in a longitudinal direction of the material-mounting table (9), said cutting machine (1) further comprising: a blade-supporting member (27) which vertically and slidably supports said cutter blade (21), said blade-supporting member (27) is supported by a slidable block (50) which is supported by a casing (26), said blade-supporting member (27) is pivotably controlled by a blade-tip direction controller (25) to control a cutting direction of the cutter blade (21), said blade-supporting member (27) includes a bottom surface which comes into contact with a top surface of the cuttable material (6) and includes an abnormal condition detector (28) in which a rack (56) is secured to said casing (26), a pinion gear (55) is disposed to said slidable block (50) to engage with the rack (56), and said abnormal-condition detector (28) detects a relative displacement amount between said casing (26) and said slidable block (50) by measuring a rotation of the pinion gear (55) with a rotary encoder (54), whereby a rise of said cuttable material in a direction of a movement of said cutter blade (21) is detected.

* * * * *